US011318334B2

(12) United States Patent
Haggett

(10) Patent No.: US 11,318,334 B2
(45) Date of Patent: May 3, 2022

(54) FIREFIGHTING UTILITY TOOL

(71) Applicant: Mikel Haggett, Barstow, CA (US)

(72) Inventor: Mikel Haggett, Barstow, CA (US)

( * ) Notice: Subject to any disclaimer, the term of this patent is extended or adjusted under 35 U.S.C. 154(b) by 90 days.

(21) Appl. No.: 16/745,868

(22) Filed: Jan. 17, 2020

(65) Prior Publication Data

US 2020/0230451 A1 Jul. 23, 2020

Related U.S. Application Data

(60) Provisional application No. 62/793,937, filed on Jan. 18, 2019.

(51) Int. Cl.
*A62C 8/04* (2006.01)
*B25F 1/02* (2006.01)

(52) U.S. Cl.
CPC . *A62C 8/04* (2013.01); *B25F 1/02* (2013.01)

(58) Field of Classification Search
CPC ..... A62C 8/04; B25F 1/02; B27B 17/02
USPC ..... 7/116
See application file for complete search history.

(56) References Cited

U.S. PATENT DOCUMENTS 4,341,017 A * 7/1982 Janczak ..... A01G 3/08 30/296.1
4,999,917 A * 3/1991 Neville ..... A01G 3/08 30/296.1
5,105,493 A 4/1992 Lugtenaar
5,211,118 A 5/1993 Perkins
5,218,767 A * 6/1993 Wells ..... B23Q 11/0035 30/277.4
6,289,540 B1 9/2001 Emonds
6,560,805 B2 5/2003 Dallas et al.
10,081,097 B1 * 9/2018 Abbey ..... B25B 25/00
2004/0006824 A1 1/2004 Huang
2006/0060668 A1 3/2006 Gunter et al.
2010/0269648 A1 * 10/2010 Fenstemaker ..... B25F 1/02 81/491
2014/0137338 A1 * 5/2014 Meinzer ..... B25H 3/02 7/116
2017/0021486 A1 * 1/2017 Reissmann ..... A01G 29/00
2018/0290032 A1 * 10/2018 Solheim ..... A63B 21/4035

* cited by examiner

*Primary Examiner* — David B. Thomas
*Assistant Examiner* — Jonathan G Santiago Martinez
(74) *Attorney, Agent, or Firm* — Boudwin Intellectual Property; Daniel Boudwin

(57) ABSTRACT

A firefighting utility tool including a handle member and a tool head. The handle member has one of a variety of tool heads attached to a bottom side thereof. The handle is a solid tubular member with a hollow interior that allows water to pass therethrough. The top end of the handle member has a hose coupling located thereon such that a hose can be connected and water can flow into the hollow interior of the handle member. There are a plurality of holes located in the handle member toward the bottom end of the handle member. The holes allow water to exit the handle. The tool allows water to pass through the handle and out of the plurality of holes such that the water can be directed toward a fire without interfering with normal operation of the tool.

20 Claims, 4 Drawing Sheets

FIREFIGHTING UTILITY TOOL

CROSS REFERENCE TO RELATED APPLICATIONS

This application claims the benefit of U.S. Provisional Application No. 62/793,937 filed on Jan. 18, 2019. The above identified patent application is herein incorporated by reference in its entirety to provide continuity of disclosure.

BACKGROUND OF THE INVENTION

The present invention relates to firefighting utility tool. More particularly, the present invention provides a tool that is capable of digging or cutting and spraying water at the same time.

When fighting a fire it is often required to use a hand tool and at the same time spray water on the area that is being worked on. Currently this will require more than one individual. A first individual will have to use the tool and preform the task at hand and a second person will have to spray the area with water. This takes multiple people and requires that one individual does most of the work.

In a situation such as a forest fire time can be extremely important and further man-power can be scarce. This is due to the massive amount of area that is covered by a forest fire. It can be necessary to clear paths and at the same time apply water to them to attempt to slow the spread of the fire. This can take an immense amount of time and man-power. Different tools are also required for this action. Traditionally, each additional tool that is required will have to be transported to the work site. This could mean that many items will need to be carried into a forest to ensure the proper tools are brought to the fire.

Consequently, there is a need in for an improvement in the art of using tools to fight fires. The present invention substantially diverges in design elements from the known art while at the same time solves a problem many people face when having to use tools to clear debris and water down an area when fighting fires. In this regard the present invention substantially fulfills these needs.

SUMMARY OF THE INVENTION

The present invention provides a firefighting utility tool wherein the same can be utilized for providing convenience for the user when using a firefighting utility tool while simultaneously applying water to the fire. The firefighting utility tool includes a handle member, wherein the handle member is tubular and includes a hollow interior. The handle member includes a top end and a bottom end. The top end of the handle member has a hose coupling attached thereto. The bottom end of the handle member has a tool head attached thereto. The handle member has a plurality of apertures placed therein and positioned above the tool head.

One object of the present invention is to provide a firefighting utility tool that includes an outward taper at the top end of the handle. This will enable an individual to swing the tool and maintain a grasp on the device.

Another object of the present invention is to provide a firefighting utility tool that includes a removable tool head.

A further object of the present invention is to provide a firefighting utility tool that includes a bottom end of the handle member that is closed off with a tool head coupler.

An additional object of the present invention is to provide a firefighting utility tool is that includes a threaded portion within the coupler, wherein the removable tool head further comprises an opposite threaded section.

Yet another object of the present invention is to provide a firefighting utility tool having at least one aperture through the tool head and the bottom end of the handle member, wherein the aperture is configured to accept a locking pin therethrough, such as a cotter pin, for example.

Still a further object of the present invention is to provide a firefighting utility tool having removable tool heads that may include a shovel, a pick, or a rake, for example.

Other objects, features and advantages of the present invention will become apparent from the following detailed description taken in conjunction with the accompanying drawings.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
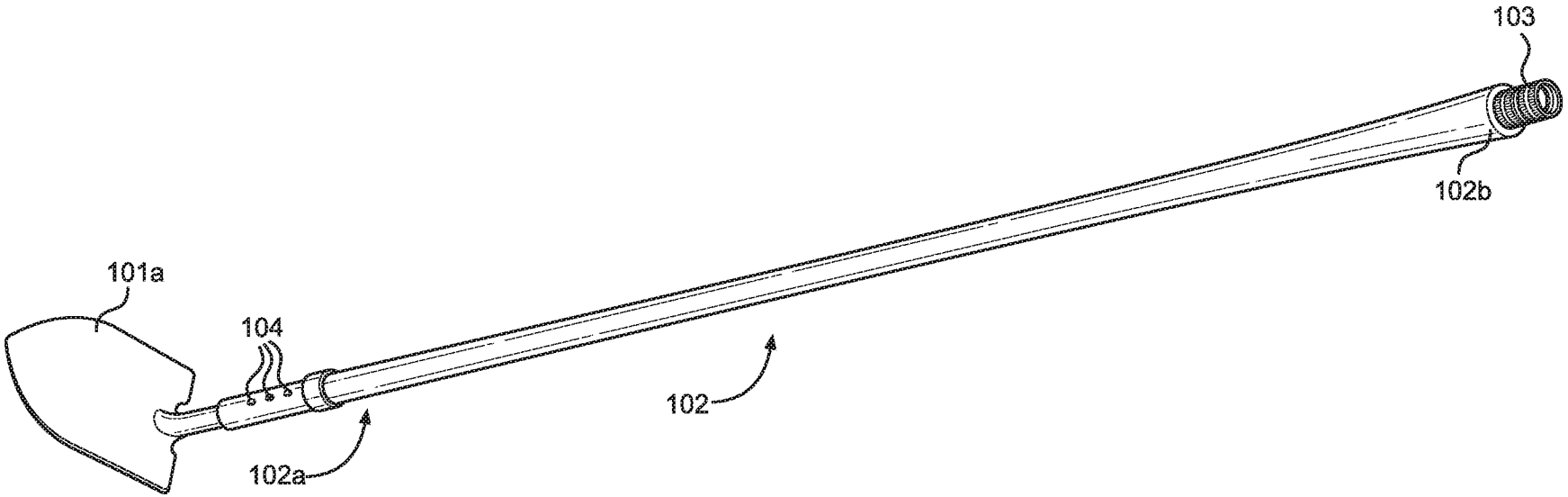
FIG. 1 shows a perspective view of an embodiment of the firefighting utility tool.

Reference is made herein to the attached drawings. Like reference numerals are used throughout the drawings to depict like or similar elements of the firefighting utility tool. For the purposes of presenting a brief and clear description of the present invention, a preferred embodiment will be discussed as used for applying water to a fire while simultaneously utilizing a particular firefighting tool attachment. The figures are intended for representative purposes only and should not be considered to be limiting in any respect.

Referring now to FIG. 1, there is shown a perspective view of an embodiment of the firefighting utility tool. The firefighting utility tool includes a tool head 101*a*, a tubular handle 102 and a hose connection 103. The tubular handle 102 is an elongated tube having a hollow interior, a lower end 102*a*, and an upper end 102*b*. In one embodiment the upper end 102*b* of the tubular handle 102 tapers outward from point along the handle toward the upper end 102*b*. This will allow the tubular handle 102 to have a better grip and make it less likely that the tool slips from the user's hand.

The tubular handle 102 has an opening at the upper end 102*b*. In one embodiment the tubular handle 102 is made from metal. The tubular handle 102 has a hose connection 103 attached to the opening on the upper end 102*b*. The hose connection 103 is configured to have a hose removably attached thereto. The tubular handle 102 has a plurality of apertures 104 located at the bottom end of the tubular handle 102*a*. The plurality of apertures 104 are fluidly connected to the tubular handle 102 such that water flows from a water source through the hose connection 103 down the hollow interior of the tubular handle 102 and out of the plurality of apertures 104.

The firefighting utility tool has a tool head 101*a* attached to the lower end 102*a* of the tubular handle 102. The tool head 101*a* in the shown embodiment is a bent forward shovel head. This will allow a person to have a digging, hoeing, and possibly cutting tool all in one. Other tool heads can be used as shown and described throughout the specification. The plurality of apertures 104 are shown to be located above the connection point of the tool head 101*a*.

Figure 2:
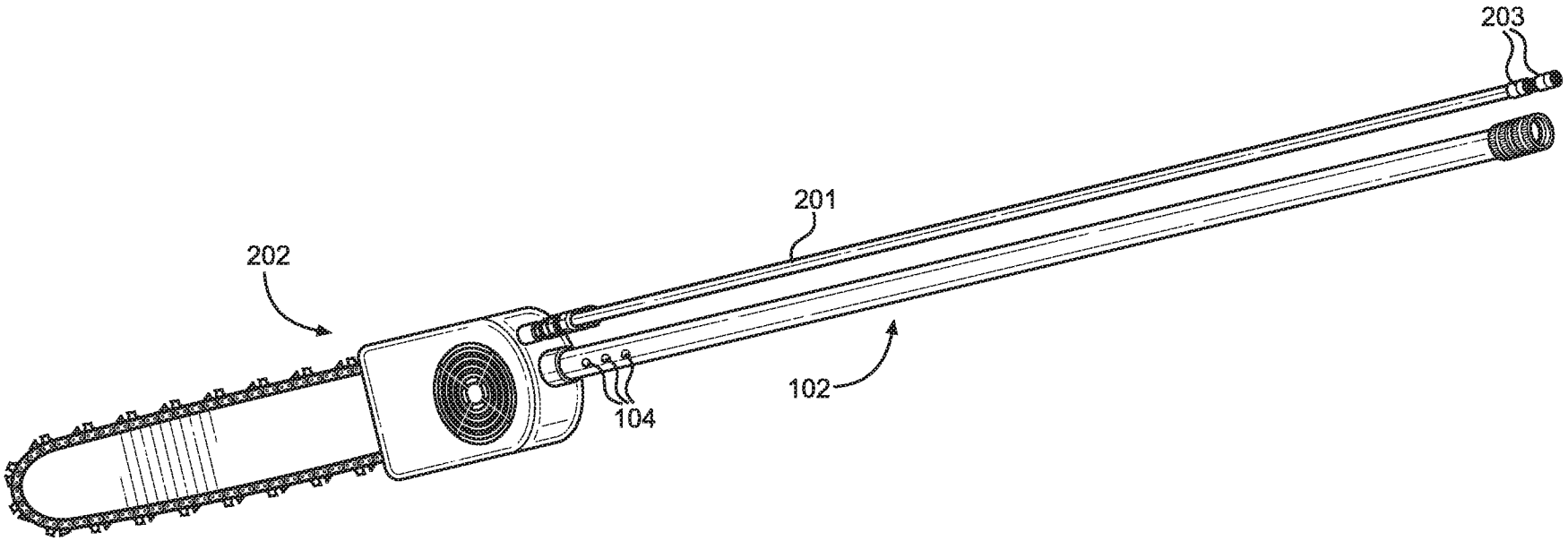
FIG. 2 shows a perspective view of an embodiment of the firefighting utility tool with a pair of second fluid supply lines.

Referring now to FIG. 2, there is shown a perspective view of an embodiment of the firefighting utility tool with a pair of second fluid supply lines. In some embodiments there are additional fluid lines 201 attached to the tubular handle 102. In one embodiment the fluid lines 201 are attached to the outside of the tubular body 102. In another embodiment the fluid lines 201 are integrated into the tubular handle 102. In one embodiment the is only a single additional fluid line 201.

In one embodiment the fluid lines 201 are air lines. In another embodiment the fluid lines 201 are hydraulic lines. The end of the fluid lines 201 have appropriate connectors 203 attached thereto. These connectors will allow for the proper device to be attached to the fluid lines 201. The connectors can include, air connectors, hydraulic connectors, water connectors, or other necessary connectors. The multiple fluid lines 201 allow multiple types of fluids to be applied as needed during the firefighting process.

In one embodiment the tool head is a hydraulic chain saw 202. This will allow for a person to cut brush and tree limbs with the firefighting utility tool. In this embodiment there is still a plurality of apertures 104 located on the tubular handle 102. This will allow an individual to cut and remove brush while at the same time watering down the area to put out a fire or prevent the spread of a fire.

Figure 3:
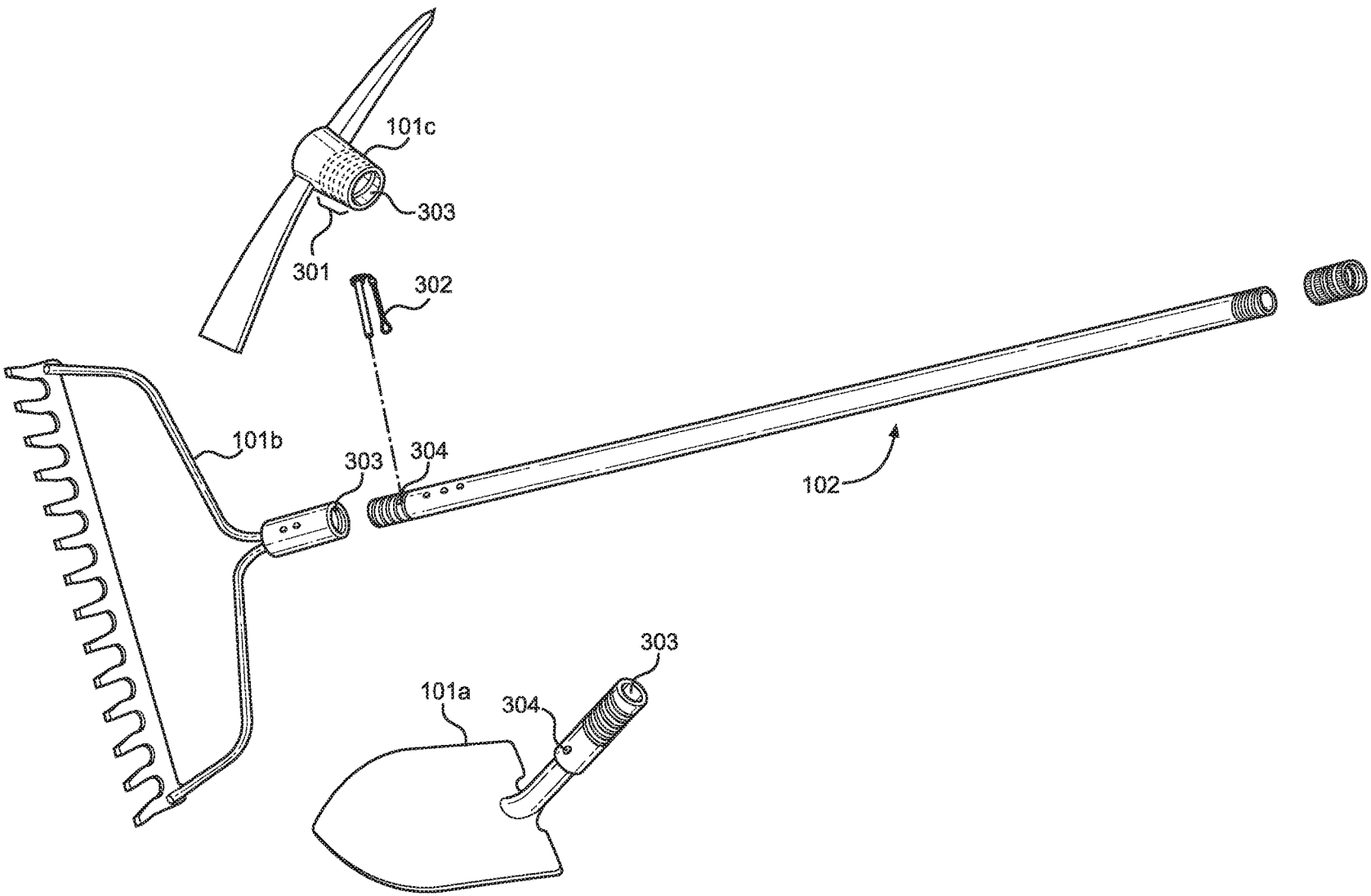
FIG. 3 shows an exploded view of an embodiment of the firefighting utility tool with removable tool heads.

Referring now to FIG. 3, there is shown an exploded view of an embodiment of the firefighting utility tool with removable tool heads. In one embodiment the firefighting utility tool may have different tool heads. In this embodiment different tool heads are fixed to the lower end of the tubular handle 102. In another embodiment the firefighting utility tool has interchangeable tool heads.

In one embodiment with interchangeable tool heads 101*a*, 101*b*, 101*c* the tool heads have each have a connector portion 303 disposed opposite the working end of the tool head. In one embodiment the connector portion 303 is a tubular portion that is configured to receive the tubular handle 102 therein. In one embodiment the connector portion 303 has a threaded section, and the lower end of the tubular handle 102 has a corresponding threaded section 301. Each of the interchangeable tool heads 101*a*, 101*b*, 101*c* has an opposite threaded section located in a connector portion 303. In a further embodiment, there is a hole located through the connector portion 303. The hole will pass through a first side of the connector portion 303 and exit an opposite side of the connector portion 303. The hole will be configured to align with an additional hole located in the lower end 102*a* of the tubular handle 102. The hole will pass through the tubular handle 102. This will allow a cotter pin 302 to be placed through the hole 304 in the connector section 303 and the hole located in the tubular handle 102, thereby removably securing one of the tool heads 101*a*, 101*b*, 101*c* to the tubular handle 102.

Figure 4:
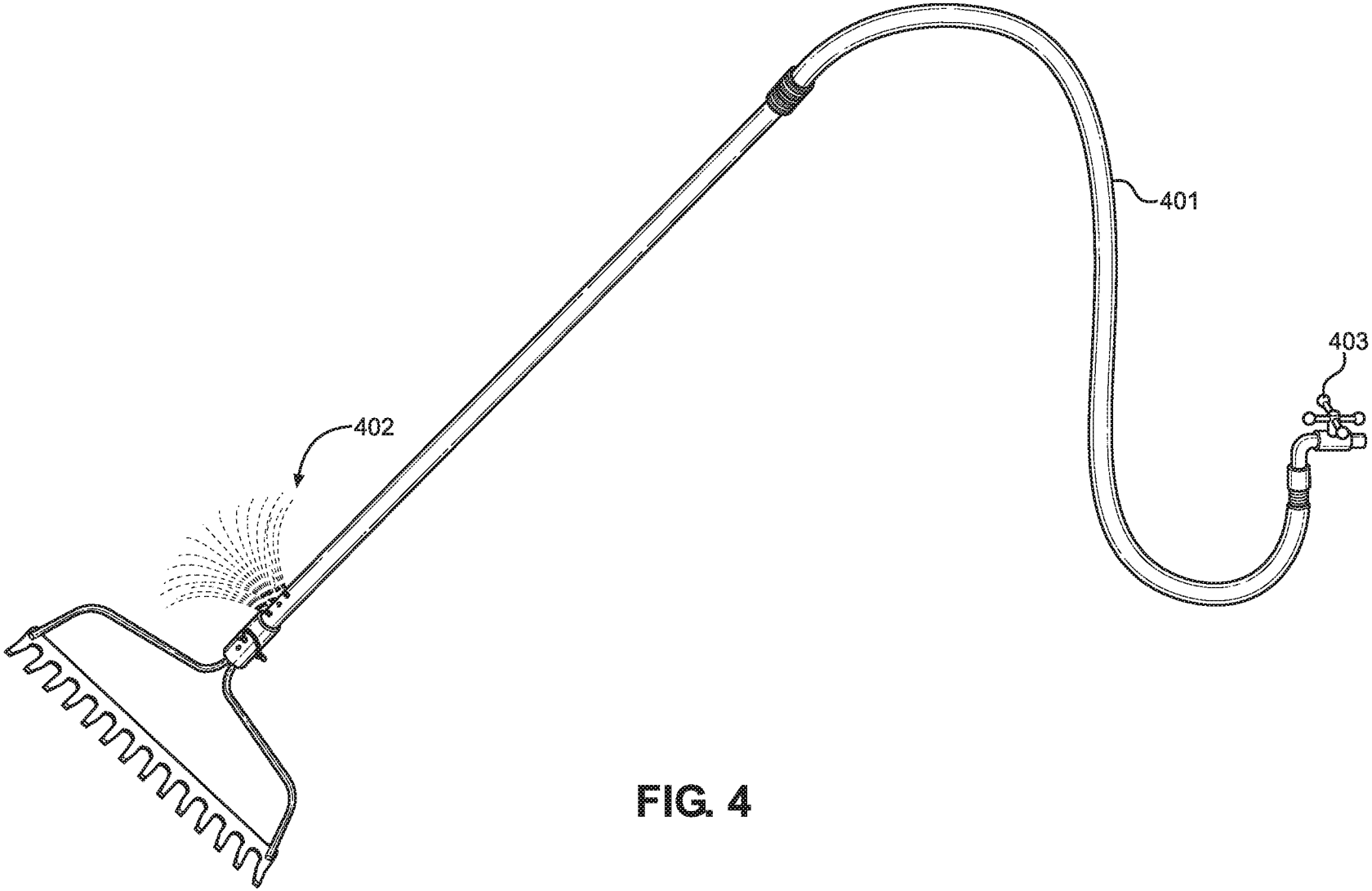
FIG. 4 shows a perspective view of an embodiment of the firefighting utility tool in use.

Referring now to FIG. 4, there is shown a perspective view of an embodiment of the firefighting utility tool in use. In use, the tubular handle 102 is connected to a hose 401. The hose 401 will be connected to a fluid supply such as a water source 403. A user will be able to use the firefighting utility tool in accordance with the chosen tool head 101. At the same time the user will be applying water to a desired area. The water will be expelled at the lower end of the tubular handle 102 as a spray 402 from the apertures 104. This will allow a user to remove debris and wet an area at the same time. This will reeve the need for one person to spray water and another to move debris.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A firefighting utility tool, comprising:

a tubular handle member having a top end, a bottom end, and a hollow interior;

a hose coupling attached to a top end of the handle;

a tool head attached to a bottom end of the handle;

a plurality of apertures disposed on the handle member positioned adjacent to the bottom end, such that each aperture of the plurality of apertures is uncovered when the tool head is attached to the handle member;

wherein each aperture of the plurality of apertures is configured to expel a volume of fluid from the hollow interior of the tubular handle member as it is received from a fluid supply connected to the hose coupling.

2. The firefighting utility tool of claim 1, wherein the handle is tapered outwardly toward the top end.

3. The firefighting utility tool of claim 1, wherein the tool head is removably secured to the bottom end of the handle.

4. The firefighting utility tool of claim 3, wherein the bottom end of the tubular handle member is closed off from the hollow interior, and wherein the bottom end of the tubular handle member has a tool head coupler.

5. The firefighting utility tool of claim 4, wherein the tool head coupler comprises a threaded portion, and wherein the tool head further comprises an opposite threaded section.

6. The firefighting utility tool of claim 5, further comprising at least one aperture extending through the tool head and the bottom end of the handle member, wherein the aperture is configured to accept a locking pin therethrough.

7. The firefighting utility tool of claim 6, wherein the locking pin is a cotter pin.

8. The firefighting utility tool of claim 1, wherein the tool head is a shovel.

9. The firefighting utility tool of claim 1, wherein the tool head is a pick.

10. The firefighting utility tool of claim 1, wherein the tool head is a rake.

11. The firefighting utility tool of claim 1, wherein each aperture of the plurality of apertures comprises an equal diameter.

12. A firefighting utility tool, comprising:

a tubular handle member having a top end, a bottom end, and a hollow interior;

a hose coupling attached to a top end of the handle;

a tool head attached to a bottom end of the handle;

a plurality of apertures disposed on the handle member positioned adjacent to the bottom end, such that each aperture of the plurality of apertures is uncovered when the tool head is attached to the handle member;

wherein each aperture of the plurality of apertures is configured to expel a volume of fluid from the hollow interior of the tubular handle member as it is received from a fluid supply connected to the hose coupling;

a second pair of tubular members running parallel to the handle member, wherein the second pair of tubular members are configured to operate a brush saw tool head.

13. The firefighting utility tool of claim 12, wherein the second pair of tubular members are air lines.

14. The firefighting utility tool of claim 12, wherein the second pair of tubular members are hydraulic lines.

15. The firefighting utility tool of claim 12, wherein the handle is tapered outwardly toward the top end.

16. The firefighting utility tool of claim 12, wherein the tool head is removably secured to the bottom end of the handle.

17. The firefighting utility tool of claim 16, wherein the bottom end of the tubular handle member is closed off from the hollow interior, and wherein the bottom end of the tubular handle has a tool head coupler.

18. The firefighting utility tool of claim 17, wherein the tool head coupler comprises a threaded portion, and wherein the tool head further comprises an opposite threaded section.

19. The firefighting utility tool of claim 18, further comprising at least one aperture extending through the tool head and the bottom end of the handle member, wherein the aperture is configured to accept a locking pin therethrough.

20. The firefighting utility tool of claim 19, wherein the locking pin is a cotter pin.

* * * * *